United States Patent [19]

Ericsson

[11] Patent Number: 4,545,131

[45] Date of Patent: Oct. 8, 1985

[54] DRIER INTENDED TO DRY PRINT ON A MATERIAL

[75] Inventor: Sylve J. D. Ericsson, Tumba, Sweden

[73] Assignee: Svecia Silkscreen Maskiner AB, Norsborg, Sweden

[21] Appl. No.: 476,272

[22] Filed: Mar. 17, 1983

[30] Foreign Application Priority Data

Mar. 17, 1982 [SE] Sweden ..... 8201690

[51] Int. Cl.[4] ..... F26B 23/04

[52] U.S. Cl. ..... 34/4; 34/41; 34/48; 34/52; 118/642

[58] Field of Search ..... 118/642, 643; 34/4, 34/41, 48, 4, 52

[56] References Cited

U.S. PATENT DOCUMENTS

| | | | |
|---|---|---|---|
| 3,218,831 | 8/1980 | Harris et al. | 34/41 |
| 3,793,741 | 2/1974 | Smith, Jr. | 34/48 |
| 3,991,484 | 11/1976 | Lamb et al. | 34/4 |
| 4,202,112 | 5/1980 | Van der Eltz | 34/41 |

*Primary Examiner*—Larry I. Schwartz

*Attorney, Agent, or Firm*—Burns, Doane, Swecker & Mathis

[57] ABSTRACT

A drier (6) intended to dry print on a material (11), consisting of a conveyor device (6*a*) for moving the material in and out of the drier and a number of drying units (14,15,16). Each is arranged so as to be capable of drying that part of the print which is situated immediately against the unit. For the purpose of drying print (12,12*a*) applied to the material (11) only those units (14*c*,14*d*,16*a*,16*b*) are used which are arranged so as to be able to dry the applied print.

8 Claims, 5 Drawing Figures

DRIER INTENDED TO DRY PRINT ON A MATERIAL

TECHNICAL FIELD

The present invention relates to a drier and in particular to a drier of a kind which is intended to be capable of drying print applied to a material, said drier incorporating a conveyor device for moving the material in and out of the drier and a number of drying units, each of which is so arranged as to be capable of drying that area of the print which lies immediately next to the unit.

DESCRIPTION OF THE PRIOR ART

Previously disclosed are a number of different driers intended to be capable of causing print applied to a material to dry. Also previously disclosed is the use of jets to cause a current of warm air to be directed against the material bearing the print, said current of warm air drying the print and in so doing also removing the products of evaporation generated by the drying of the print.

Also previously disclosed is the use of a number of organs emitting ultra-violet rays, known as UV-radiation, to dry print applied to a material, since the effect of these rays is to harden the print applied to the material. The printing ink used must as a rule be particularly sensitive in order to react to and to be dried by the emitted ultra-violet radiation.

Similarly, also previously disclosed is the use of organs emitting infra-red rays, known as IR-radiation, to dry print applied to a material, since the effect of these rays is to harden the print applied to the material. In an application of this kind it is advisable to choose a particularly sensitive printing ink which will dry or harden under the effect of IR-radiation.

Also previously disclosed, of course, are other driers specially designed to be capable of solving special problems and of effectively drying print applied to a material.

Also previously disclosed in conjunction with driers are certain measures which enable the moisture lost from the material in the course of the drying process to be replaced by causing the material to pass through special air humidifying devices or by humidifying the air present inside the drier to the required level.

DESCRIPTION OF THE PRESENT INVENTION

Technical Problem

An exacting technical problem generally associated with driers of previously disclosed designs is that these driers consume a great deal of energy and power, since the drier is designed and dimensioned in such a way that it will effectively dry a large area of print having a thick layer of ink applied to a thick material.

In view of the fact that the area of print on the material may be very limited and that the layer of ink may be very thin, difficulties are encountered in providing a simple means of adjusting the consumption of energy and power by the drier to suit a small printed area and/or thin print. If the print is to dry, a certain level of temperature and thermal energy must be transferred to and absorbed by the print. For this reason the drier has until now been dimensioned so as to be capable of drying print irrespective of its thickness and of its location on the material, and irrespective of the area of material covered with print. The power consumption of the drier can be stepped down only to a limited extent where only a small area of print is to be dried, since stepping-down will usually have the effect of reducing the temperature.

As a consequence of the above, driers of previously disclosed designs exhibit an additional disadvantage inasmuch as not only the printed area is exposed to heating, but also the whole of the material is exposed to heating.

This is, of course, a particularly difficult problem in the case of those driers into which very thick material is introduced, especially if the material has excellent heat absorption characteristics and if only a thin printed surface has been applied to the material. The temperature of the material has been found to rise considerably in an application of this kind, which leads not only to major losses of power and energy in the drier but also to corresponding losses in any subsequent cooling section.

SOLUTION

The present invention relates to a drier of a kind such that it is capable of drying print applied to a material, said drier incorporating a conveyor device for moving the material in and out of the drier and a number of drying units, each of which is so arranged as to be capable of drying that area of the print which lies immediately next to the unit.

In order to be able to reduce the consumption of energy and power by a drier of this kind and, where appropriate, to reduce the power consumption of any subsequent cooling section, the present invention proposes that for the purpose of drying print applied to a material only those units should be used which are so arranged as to be capable of drying only the print which has been applied. This means that other units intended to dry areas which have not been coated with ink are disconnected.

The present invention relates to a particularly suitable drier designed to make use of a number of IR-emitting units, each of which consists of a number of continuous IR-emitting organs. A drier of this kind permits only those units and/or the one or more organs making up the unit and located immediately next to the applied print to be switched on in a simple manner.

According to the present invention the possibility is offered of causing the material to be introduced rapidly into the drier by the conveyor device, for the purpose of positioning the material bearing the print beneath the units, whereupon the conveyor device will move the material along slowly during the period for which the units and/or the organs for drying the actual printed surface are activated, after which the material will be discharged rapidly from the drier by the conveyor device.

In view of the fact that a fall in the quality of the drying performance may be expected to occur in the gap between the units and also between the continuous organs making up the units, it is recommended that the material be allowed to move slowly through the drier during the period for which the units and/or the organs are activated.

For the purpose of achieving further improvements in the drying process and of producing complete, uniform and thorough drying of the print, it is recommended that the drying process be divided up into two stages, an initial stage in which longitudinal organs are arranged parallel to the first longitudinal areas of print and a second stage in which continuous organs are arranged at right-angles to the first continuous areas of print and parallel to the other continuous areas of print.

The present invention also offers the possibility of providing a control panel designed to be capable of switching on the one or more units and/or organs corresponding to a special print in a simple manner.

Since the IR-emitting organs generate large amounts of heat, it is recommended that a current of air be arranged so as to flow past the units and/or the organs in order not only to cool the units and the organs but also so as to be able to direct a current of warm air towards the material.

Finally, it is recommended that the units be in the form of cassettes, each one of which should contain organs arranged in parallel; a number of cassettes attached to a framework will form the upper part of the drier.

ADVANTAGES

The principal advantages which may be regarded as being associated with a drier in accordance with the present invention are the possibility of selectively determining the units and/or the one or more organs making up the units so as to be able to concentrate the drying process only on those areas of the material to which print has been applied, thereby guaranteeing the additional advantage that the material will not absorb an excessive amount of thermal energy, as a result of which a limited cooling of the material will be sufficient to reduce the temperature of the material to the temperature which the material exhibited before being treated in the drier.

What may be regarded as being the principal characteristic features of a drier in accordance with the present invention are indicated in the first characterising part of the following patent claims.

BRIEF DESCRIPTION OF THE DRAWINGS

A preferred embodiment exhibiting the significant characteristic features of the present invention is described below with reference to the attached drawing.

The attached drawing shows the following.

DESCRIPTION OF THE PREFERRED EMBODIMENT

Figure 1:
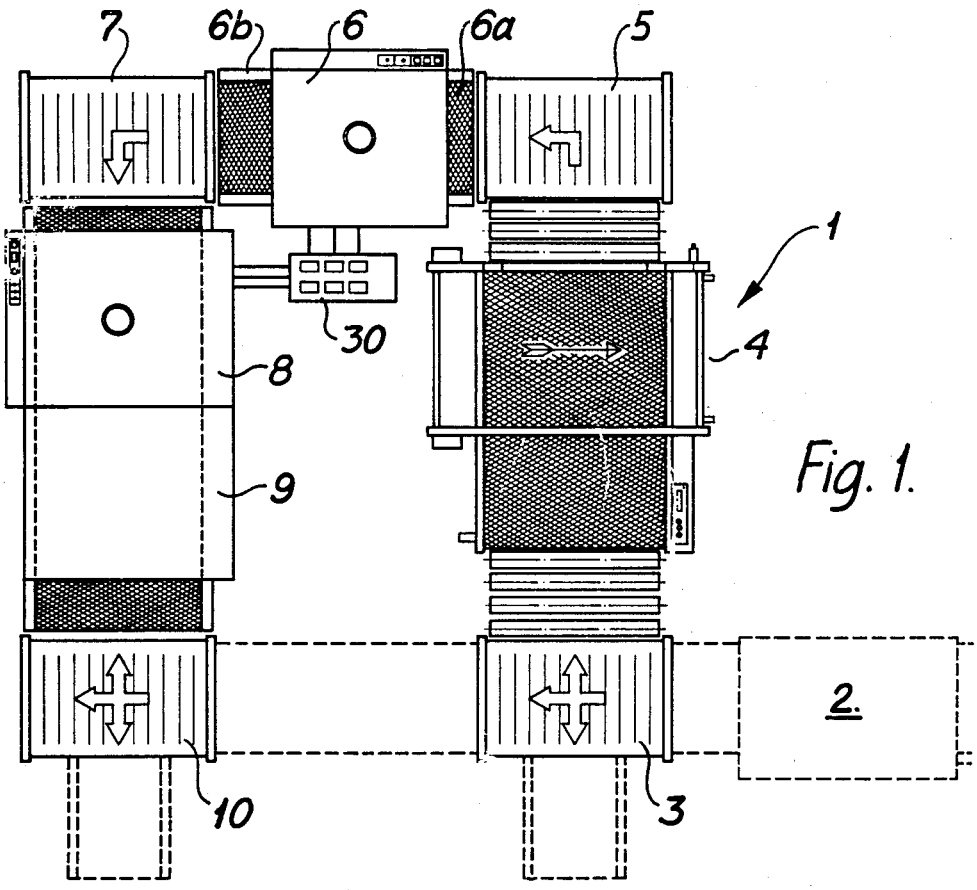
FIG. 1 a plan view of a two-stage drier in accordance with the present invention installed in a production line.

The production line shown in FIG. 1 represents the manufacturing process for printed plate glass, i.e. it uses a glass material to which print is applied by means of a screen printing machine. This print must be dried in driers which are significant to the present invention. It is clear, however, that the principle of the invention is not restricted to the indicated application, but that it may be applied to any kind of material to which any kind of print has been applied.

The production line 1 shown in FIG. 1 also includes a raw material cutting operation, which is not illustrated here, enabling the raw material in the form of glass to be given the desired dimensions after it has been broken, a grinding operation, which is not shown here, for the first pair of opposite edges of the glass material, a grinding operation, which is not shown here, for the second pair of opposite edges of the glass material, and possibly an operation, which is not shown here, for drilling holes in the glass material, following which the glass material, i.e. the sheet of glass, is fed into a device 2 in which the surface of the glass material is washed.

The glass material is then placed on an inclined conveyor table 3 where it is accurately positioned, after which the glass material is transferred to a printing machine 4 (a screen printing machine), on which print is applied to the upper surface of the material. The glass material is then moved onto an inclined conveyor table 5 and into a drier 6 designed in accordance with the present invention. Advantages may be gained from the use of an intermittent transport process.

After the print or the printed surface applied to the glass material has been dried in the drier device 6 the glass material is transferred to an inclined conveyor table 7, whereupon the material is transported to a further drier device 8 for final drying of the print, whereupon the glass material is transported to a cooling section 9 and finally to an inclined conveyor table 10.

Figure 2:
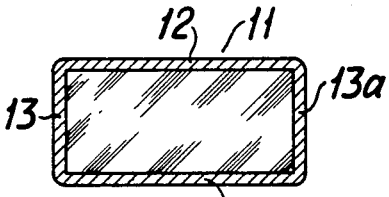
FIG. 2 a plan view of a piece of material with small areas of print applied to it.

The glass material 11 has been illustrated in FIG. 2 as a flat sheet of glass, and at the stage at which the material is transported from the inclined conveyor table 5 and into the drier 6 the sheet of glass 11 has been printed with initial longitudinal areas of print 12,12*a* and with other longitudinal areas of print 13,13*a* applied to the edge surfaces of the sheet of glass 11 by the printing machine 4.

The drier 6, which is intended to dry print 12,12*a*,13,-13*a* applied to a piece of material 11, incorporates a conveyor device 6*a*,6*b* for moving the material in and out of the drier together with a number of drying units. These will be described below in greater detail with reference to FIGS. 3–5. It may be stated at this stage that the material 11 (the sheet of glass) rests on the conveyor device 6*a*,6*b* and that the print is applied to its upper surface. At the stage at which the material is transported into the drier the drying units located inside the drier are arranged so that their effect will be directed towards the upper surface of the material. The units are positioned directly above the applied print.

At the same time, however, each of the units is capable of being used to dry that part of the print which is located immediately next to and below the unit, and according to the present invention only those units which are positioned so as to be capable of drying the applied print shall be used to dry print applied on top of the material, whereas any other units which are arranged so as to be capable of drying any print which might be present on other sections of the material are completely disconnected.

Figure 3:
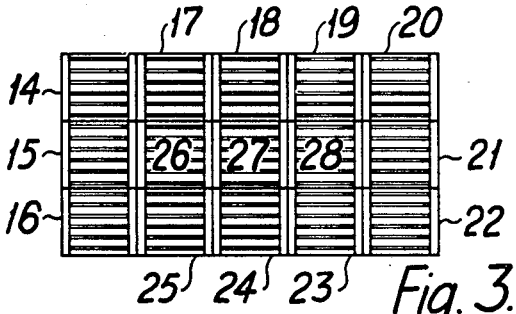
FIG. 3 the under surface of the upper part of a drier with a number of IR-emitting units, each of which consists of a number of continuous IR-emitting organs arranged so as to be capable of being used in the first stage of the drying process.

In the event of the drier illustrated in the preferred embodiment using a number of IR-emitting units, which have been given the reference designations 14–28 in FIG. 3, each of which consists of a number of continuous IR-emitting organs or elements (four continuous IR-emitting organs are shown for each unit in the diagram for the preferred embodiment), all the organs should be positioned one after the other and/or parallel to each other. These units are placed in the cover of the drier 6 and the radiant energy is directed towards the upper surface of the glass material 11. According to the present invention only those units and/or the one or more organs making up the units and located immediately next to the print applied to the material shall be activated. This produces the advantage that the thermal radiation is concentrated only on those parts where print is present, with the result that the heating of the material, which is in itself undesirable, occurs only in those areas where print is present.

With reference to FIG. 3, and with regard to the areas of print 12,12*a* and 13,13*a* indicated in FIG. 2, it may be desirable to cause all the IR-emitting organs included in the units 15 and 21 to be activated, whereas the units 14,17,18,19 and 20 will require only two IR-emitting organs, i.e. those located towards the centre of the drier, to be activated, and the units 16,25,24,23 and 22 will also require only two IR-emitting organs, i.e. those located towards the centre of the drier, to be activated. All the IR-emitting organs in the units 26,27 and 28 can now be completely disconnected.

This arrangement enables the effectiveness of the drier to be concentrated only onto those parts 12,12*a* and 13,13*a* of the material to which print has been applied and where drying is required.

Since the effect of the organs on the print is dependent on position, it is recommended in accordance with the present invention that, during the period for which the units and/or the organs are activated, the material 11 be caused to move along slowly and a little at a time, which will cause all the organs in the units 15 and 21 to be activated. The direction in which the material 11 is to be fed into the drier 6 and the position of the IR-emitting organs are indicated by means of an arrow in FIG. 3.

In view of the variation in drying which can arise as a result of the position of the organs and the direction in which the material is transported, it is recommended in accordance with the present invention that the drying process be divided up into two stages, i.e. an initial stage in the drier 6 and a second stage in the drier 8, thereby making it possible to ensure that the continuous organs are positioned parallel to the first longitudinal areas of print 12,12*a* during the first stage, but that in the second stage the continuous IR-emitting organs are positioned at right-angles to the first continuous areas of print 12,12*a* and parallel to the other continuous areas 13,13*a*.

Figure 4:
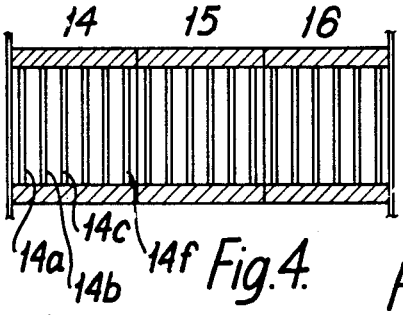
FIG. 4 a plan view of three IR-emitting units joined together.

FIG. 4 shows a plan view of three IR-emitting units 14,15 and 16 positioned side by side and designed in the form of cassettes capable of being introduced into the cover of the driers 6 and 8. FIG. 4 shows that each unit is made up of six IR-emitting organs designated 14*a*–14*f* and in accordance with the present invention it is advantageous to arrange a control circuit 30 by means of which the separate switching of each of these organs 14*a*–14*f* is possible so that one or more may be switched on depending on the shape of the print on the material.

In view of the fact that the temperature curves may vary between the IR-emitting organs and between the units, the present invention recommends that as soon as the material has been introduced into the drier 6 or into the drier 8 by means of a rapid movement, the material should then be moved along slowly during the drying process.

It may be mentioned at this stage that the transport of the material 11 along the production line 1 is essentially a non-continuous process, i.e. the material is introduced into the printing machine 4 and remains inside the machine 4 where print is applied, whereupon it is transported to the table 5 and remains on the table, and is then transported to the drier 6 and remains inside the drier where it is subjected to heat, and is then transported to the table 7 and remains on the table, and is then transported to the drier 8 where it is subjected to further heat, etc. The material may continue to move along during the actual heat treatment.

With regard to the IR-emitting units it is recommended in accordance with the present invention that very high power be supplied to the IR-emitting organs so that the actual drying process can take place within a few seconds. Provided that the IR-emitting units are of the type manufactured by Philips and sold under the model reference IMR 020/6 as 1000 W IR-emitting units, then in the case of each organ the distance between the IR-emitting organs and the surface of the material 11 to which print has been applied shall be approximately 10 mm.

Although the present invention has been illustrated in relation to a drier in which a number of IR-emitting units are used, it is obvious that the invention may also be used with other fundamentally different driers, i.e. driers operating with warm air or UV-radiation, etc. In the case of the first type of device the jets must, of course, be positioned and be so arranged that they can be controlled with regard to their switching on and off, thereby enabling the hot air to be concentrated only on those parts of the material to which print has been applied.

Figure 5:
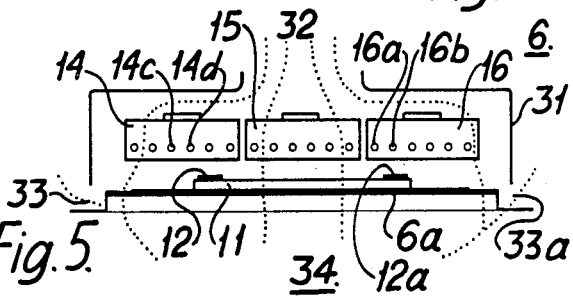
FIG. 5 a cross-section through the drier.

FIG. 5 shows a sectional view of the drier. The position of the cassettes 14,15 and 16, a conveyor 6*a* and a cover 31 may be seen here.

A current of air passes through an opening 32 and also through two other openings 33,33*a* and cools the IR-emitting organs of the cassettes, at the same time removing the products of evaporation released by the print applied to the material 11 via an exhaust opening 34.

The drying of the print 12 on the material 11 requires only the organs 14*c* and 14*d*, together with the similarly positioned organs in the similarly located units 17,18,19 and 20, to be activated, and the drying of the print 12*a* on the material 11 requires only the organs 16*a* and 16*b*, together with the similarly positioned organs in the similarly located units 25,24,23 and 22, to be activated.

The invention is not, of course, restricted to the embodiment described above by way of an example, but may be modified within the context of the following patent claim.

I claim:

1. A drier device for drying print applied on a material according to a pattern, said drier device comprising a conveyor means for moving the material to and from the drier device at a high speed sequence, a plurality of drying units, each drying unit comprising a plurality of drying elements for drying print applied to the material, control means for activating a number of drying elements according to the pattern of the applied print, and means for moving the material along a path passing adjacent said drying units in a slow speed sequence during the period of activation of the number of elements, said elements being aligned parallel with said path, said units extending across said path.

2. A drier device in accordance with claim 1, wherein said drier device also includes means for directing a current of air to pass by the elements and against the material.

3. A drier system for drying print, which print is applied on a material according to a pattern of first and second areas of print, said first and second areas extending at right angles to each other, said system comprising first and second drier devices and means for conveying material along first and second paths, said paths being at right angles to each other, each drier device comprising a number of parallel continuous IR-radiating elements, said first drier device being positioned along said first path so that the parallel continuous elements of said first drier device are parallel to said first path, said second drier device being positioned along said second path so that the parallel continuous elements of said second drier device are arranged at right-angles to said first path and parallel to said second path.

4. A drier system in accordance with claim 3, wherein the drier devices include cassettes, each cassette containing elements arranged in parallel relationship, said cassettes forming an upper part of each drier device.

5. A drier system in accordance with claim 3, wherein said control means includes a control panel.

6. A drier system in accordance with claim 3, wherein each drier device includes means for directing a current of air to pass by the elements and against the material.

7. A drier system for drying print which is applied on a material according to a pattern of first and second areas of print, said first and second areas extending at a substantially right angle to each other, said system comprising first and second drier devices and means for conveying material along first and second paths, said paths being at said substantially right angle to each other, each drier device comprising parallel continuous IR-radiating elements, said first drier device being positioned along said first path so that the parallel continuous elements of said first drier device is parallel to said first path and said second drier device being positioned along said second path so that the parallel continuous elements of said second drier device are arranged parallel to said second path, said drier system further comprising a control means for activating elements of said first and second drier devices according to said first and second areas, respectively, said means for conveying said material moving said material at a slow speed sequence through said first and second drier devices and moving said material at a high speed sequence to and from said first and second drier devices.

8. The drier system of claim 7, wherein said means for conveying material moves said material along said first path such that said first area is parallel to said first path, said controller means activating continuous elements of said first drier device which are adjacent and parallel to said first area, said means for conveying moving said material along said second path such that said second area is parallel to said second path, said controller means activating the continuous elements of said second drier device which are adjacent and parallel to said second area.

* * * * *